US009899748B2

(12) United States Patent
Kunimi

(10) Patent No.: US 9,899,748 B2
(45) Date of Patent: Feb. 20, 2018

(54) TERMINAL CONNECTION STRUCTURE AND METHOD FOR PRODUCING SAME

(71) Applicant: TABUCHI ELECTRIC CO., LTD., Osaka-shi, Osaka (JP)

(72) Inventor: Takenori Kunimi, Osaka (JP)

(73) Assignee: Tabuchi Electric Co., Ltd., Osaka (JP)

( * ) Notice: Subject to any disclaimer, the term of this patent is extended or adjusted under 35 U.S.C. 154(b) by 0 days.

(21) Appl. No.: 15/418,852

(22) Filed: Jan. 30, 2017

(65) Prior Publication Data

US 2017/0141483 A1 May 18, 2017

Related U.S. Application Data

(63) Continuation of application No. PCT/JP2014/070260, filed on Jul. 31, 2014.

(51) Int. Cl.

| | |
|---|---|
| ***H01R 4/24*** | (2006.01) |
| ***H01R 4/02*** | (2006.01) |
| ***H01R 4/62*** | (2006.01) |
| ***H01R 43/02*** | (2006.01) |
| *H01R 101/00* | (2006.01) |

(52) U.S. Cl.

CPC ..... *H01R 4/024* (2013.01); *H01R 4/625* (2013.01); *H01R 43/02* (2013.01); *H01R 2101/00* (2013.01)

(58) Field of Classification Search

CPC ..... H01R 4/024; H01R 4/023; H01R 43/02; H01R 4/625

See application file for complete search history.

(56) References Cited

FOREIGN PATENT DOCUMENTS

| | | | |
|---|---|---|---|
| JP | 54-84071 | U | 6/1979 |
| JP | 1-132077 | A | 5/1989 |
| JP | 8-31469 | A | 2/1996 |
| JP | 9-204947 | A | 8/1997 |
| JP | 2006-107882 | A | 4/2006 |
| JP | 2007-12329 | A | 1/2007 |
| JP | 2010-182566 | A | 8/2010 |
| JP | 2011-60778 | A | 3/2011 |
| JP | 2011-216459 | A | 10/2011 |

(Continued)

OTHER PUBLICATIONS

Machine translation of JP 2012-185985, Miyamoto et al, 2012.*

(Continued)

*Primary Examiner* — Ross Gushi

(74) *Attorney, Agent, or Firm* — Birch, Stewart, Kolasch & Birch, LLP

(57) ABSTRACT

A terminal connection structure for an electric wire end portion (12*a*) in which the electric wire end portion is soldered being exposed on a flat-plate terminal piece (11*b*) out from inside of a terminal main part (11*a*), the terminal piece being continuous with a front end of the terminal main part (11*a*). The electric wire end portion (12*a*) exposed on the terminal piece (11*b*) from the terminal main part (11*a*) includes a first end section (12*a*1) that is close to the terminal main part (11*a*) and a second end section (12*a*2) that is far from the terminal main part (11*a*). The electric wire end portion (12*a*) has a shape, in side view, such that the first end section (12*a*1) is compressed to have a gentle curved surface that approaches the terminal piece (11*b*) toward the second end section (12*a*2).

10 Claims, 8 Drawing Sheets

(56) References Cited

FOREIGN PATENT DOCUMENTS

| | | | |
|---|---|---|---|
| JP | 2012-185985 | A | 9/2012 |
| JP | 2014-33547 | A | 2/2014 |

OTHER PUBLICATIONS

Machine translation of JP 2011-216459, Kunimi, 2011.*
Machine translation of JP 01-132077 (1989-132077), Horibe et al., 1989.*
Notification of Reason(s) for Rejection dated Oct. 18, 2016 on related Japan Application No. 2013-024763 with English Summary.

* cited by examiner

"CONVENTIONAL ART"

"CONVENTIONAL ART"

TERMINAL CONNECTION STRUCTURE AND METHOD FOR PRODUCING SAME

CROSS REFERENCE TO THE RELATED APPLICATION

This application is a continuation application, under 35 U.S.C. § 111 (a) of international application No. PCT/JP2014/070260, filed Jul. 31, 2014.

BACKGROUND OF THE INVENTION

Field of the Invention

The present invention relates to a terminal for aluminum electric wire connection and a method for producing the same.

Description of Related Art

In recent years, there are increasing demands for an aluminum electric wire, which is light in weight and low in cost, for the purpose of achieving both an improvement of energy efficiency and a reduction of cost. In a case where this electric wire having the above characteristics is connected to an electric apparatus, means for connecting copper and aluminum is needed because a wire in the electric apparatus is copper in many cases, and a copper-alloy terminal is often used as such means. Various methods such as a method using soldering, a method using an ultrasonic wave, a method using fusing, and a method using laser have been proposed as a method for the terminal connection. Especially soldering is an excellent method that provides reliable joining because soldering makes it possible to firmly connect an entire connection part in a case where a large number of aluminum wires are connected.

However, in general, in a case where an aluminum electric wire is connected to a copper-alloy terminal, an aluminum wire in the terminal does not reach a predetermined necessary temperature due to low heat conductivity of the copper-alloy terminal even when the terminal is heated in soldering. It is therefore undesirably hard to introduce a flux or molten solder into the whole of the inside of the terminal. This results in formation of voids in the solder and parts that are not soldered, thereby causing a problem that the reliability of electrical joining becomes low. The voids can be a cause of discharge, occurrence of electric erosion, an increase of electric resistance, generation of heat during application of electricity, and the like and are therefore not desirable. Furthermore, the voids easily include air and moisture, and thermal conductivity decreases due to the presence of air and moisture. This leads to less certainty of joining. Meanwhile, in a case where the terminal and an end of the electric wire are compressed by swaging with great force in order to reduce voids and improve thermal conductivity, there is a risk of damaging of the electric wire and even breaking of the electric wire.

Techniques concerning joining between an electric wire and a terminal are, for example, disclosed in Patent Document 1 and Patent Document 2. Patent Document 1 discloses a technique concerning a connection terminal for ultrasonic wave joining between an aluminum electric wire and a terminal made of copper using an ultrasonic horn chip, and Patent Document 2 discloses a technique concerning a terminal metal fitting including a pipe-like conductor connection part that is integral with a plate member main body made of aluminum and into which a twisted-wire conductor is inserted, and a dissimilar-metal layer that is made of a metal that is not aluminum and is provided on a bottom surface of the plate member main body.

RELATED DOCUMENT

Patent Document

[Patent Document 1] JP Laid-open Patent Publication No. 2007-12329

[Patent Document 2] JP Laid-open Patent Publication No. H09-204947

SUMMARY OF THE INVENTION

In view of the circumstances, the applicant of the present application has conceived of a terminal joining structure for an electric wire end portion illustrated in FIG. 11. This structure is provided in Japanese patent application No. 2010-200802 by the applicant of the present application.

The terminal joining structure for an electric wire end portion illustrated in FIG. 11 is described below. A terminal 11 is made up of a tubular terminal main part 11*a* and a terminal piece 11*b* having a flat-plate shape that is continuous with the terminal main part 11*a*. The terminal piece 11*b* has a terminal hole 11*c*. An electric wire 12 is formed of a large number of aluminum wires twisted together, and enamel insulation coating has been removed from an end portion 12*a* of the electric wire 12. The electric wire end portion 12*a* is inserted into the terminal main part 11*a* and is exposed on the terminal piece 11*b* outside the terminal main part 11*a*.

A plurality of linear heat transmitting members 13 are inserted into the electric wire end portion 12*a* so as to be apart from one another by an appropriate interval. Each of the heat transmitting members 13 forms a high-temperature passage for solder introduction in the electric wire end portion 12*a* during soldering. In this state, for soldering, first and second electrodes 14*a* and 14*b* are disposed on an outer side in a radial direction of the terminal main part 11*a* so as to face each other, and third and fourth electrodes 15*a* and 15*b* are disposed on an outer side in a radial direction of the terminal piece 11*b* so as to face each other.

Next, as illustrated in FIGS. 11 and 12, the first and second electrodes 14*a* and 14*b* are moved in a direction indicated by arrow from the aforementioned locations so as to press the terminal main part 11*a* from both sides thereof. In this way, the terminal main part 11*a* is nipped by the first and second electrodes 14*a* and 14*b*. Similarly, as illustrated in FIGS. 11 and 12, the third and fourth electrodes 15*a* and 15*b* are moved in a direction indicated by arrow from the aforementioned locations so as to press the terminal piece 11*b* and the electric wire end portion 12*a* from both ends thereof. In this way, the terminal piece 11*b* and the electric wire end portion 12*a* are nipped by the third and fourth electrodes 15*a* and 15*b*.

In this state, the terminal main part 11*a*, the terminal piece 11*b*, and the electric wire end portion 12*a* are heated by applying an electric current between the first and second electrodes 14*a* and 14*b* and between the third and fourth electrodes 15*a* and 15*b*. Heating of the electric wire end portion 12*a* by the third and fourth electrodes 15*a* and 15*b* is transmitted to the electric wire end portion 12*a* via the heat transmitting members 13 in the terminal main part 11*a*. As a result, the electric wire end portion 12*a* in the terminal main part 11*a* is evenly heated. This allows a flux and solder to be efficiently introduced into the electric wire end portion 12*a* in the terminal main part 11*a*, thereby accomplishing soldering with certainty.

However, in a case where the electric wire end portion 12*a* exposed on the terminal piece 11*b* is temporarily sectioned to a first end 12*a*1 that is close to the terminal main part 11*a* and a second end 12*a*2 that is far from the terminal main part 11*a*, the first end 12*a*1 is not pressed against the inside of the terminal piece 11*b* by the third electrode 15*a*, but the second end 12*a*2 is pressed against the inside of the terminal piece 11*b* by the third electrode 15*a*.

This creates a sharp difference in height between the first end 12*a*1 and the second end 12*a*2. Furthermore, since the electric wire end portion 12*a* is an aluminum wire and is therefore hard to heat, an electric current applied between the third and fourth electrodes 15*a* and 15*b* becomes excessively large. Accordingly, the end 12*a*2 is heated to an excessively high temperature, and stress acts between the end 12*a*1 and the end 12*a*2. This undesirably increases the possibility of damaging of the electric wire end portion 12*a*.

In view of this, a main purpose of the present invention is to provide a terminal connection structure in which the aforementioned sharp difference in height is not present and the shape of a third electrode is improved, and a method for producing such a terminal connection structure.

In order to attain the purpose, a terminal connection structure according to the present invention is a terminal connection structure for an electric wire end portion in which the electric wire end portion is soldered being exposed on a flat-plate terminal piece out from inside of a terminal main part, the terminal piece being continuous with a front end of the terminal main part, wherein the electric wire end portion exposed on the terminal piece from the terminal main part includes a first end section that is close to the terminal main part and a second end section that is far from the terminal main part, and the electric wire end portion has a shape, in side view, such that the first end section is compressed to have a gentle curved surface that approaches the terminal piece toward the second end section.

In the terminal connection structure according to the present invention, the electric wire end portion exposed on the terminal piece has a shape, in side view, such that the first end section is compressed to have a gentle curved surface that approaches the terminal piece toward the second end section. This allows stress acting between the first end section and the second end section to be dispersed, thereby preventing the electric wire end portion from being broken at a part where the electric wire end portion is exposed on the terminal piece from the terminal main part. It is therefore possible to provide a terminal connection structure that has high mechanical reliability.

In one embodiment of the present invention, an inclination angle θ of an intermediate part of the first end section in a longitudinal direction is 20° to 70° on an upper side that is a side far from a soldering surface on which the electric wire end portion on the terminal piece is soldered.

In another embodiment of the present invention, a recess having a gently inclined side wall surface is provided in a soldering surface on which the electric wire end portion on the terminal piece is soldered. It is preferable that a protrusion that promotes thermal conduction between the electric wire end portion and the terminal piece or a protrusion around which the electric wire end portion is wound is provided in the recess.

In a further embodiment of the present invention, a pair of restricting walls that regulate spread of the electric wire end portion on a soldering surface on which the electric wire end portion on the terminal piece is soldered are provided along respective side edges of the soldering surface.

A method for producing a terminal connection structure according to the present invention is a method in which an electric wire end portion is soldered being exposed on a flat-plate terminal piece from inside of a terminal main part, the terminal piece being continuous with a front end side of the terminal main part, the method including the steps of: heating the terminal piece and the electric wire end portion by applying an electric current between a pair of electrodes in a state where the terminal piece and the electric wire end portion exposed on the terminal piece are pressed from both sides thereof in a radial direction by the pair of electrodes; and introducing a flux and then solder into the inside of the terminal main part and onto the terminal piece in a state where the terminal piece and the electric wire end portion are heated, wherein one of the pair of electrodes that presses the electric wire end portion has a curved surface shape or a tapered surface shape at an edge part thereof that is on a radially inner side and on a terminal main part side.

In the method for producing a terminal connection structure according to the present invention, one of the pair of electrodes that presses the electric wire end portion has a curved surface shape or a tapered surface shape at an edge part thereof that is on a radially inner side and on a terminal main part side. Accordingly, when the pair of electrodes are pressed against the terminal piece and the electric wire end portion exposed on the terminal piece from both sides thereof in the radial direction, the electric wire end portion exposed on the terminal piece is pressed so that the first end section is compressed to have, in side view, a gentle curved surface that approaches the terminal piece toward the second end section. This allows stress acting between the first end section and the second end section to be dispersed, thereby preventing the electric wire end portion from being broken at a part where the electric wire end portion is exposed on the terminal piece from the terminal main part.

Furthermore, in a case where the terminal piece and the electric wire end portion are heated by applying an electric current between the electrodes, the electric current flows in a scattered manner throughout the electric wire end portion from the first end section side to the second end section side. Thus, a rise in temperature caused by heating of the electric wire end portion becomes gentle, leading to improvement in performance of a subsequent soldering process in which a flux and solder are introduced. Furthermore, since the electric wire end portion is heated by applying an electric current between the third electrode and the fourth electrode in a state where the electric wire end portion is nipped by the pair of third and fourth electrodes that face each other in the radial direction and the electric wire end portion is soldered by introducing solder and a flux into the terminal main part, the electric wire end portion and the terminal are soldered onto each other without creating voids in the terminal. As a result, it is possible to provide a terminal connection structure that is free from troubles caused by voids and that accomplishes a good solder connection state.

One embodiment of the method according to the present invention further includes the step of heating the terminal main part and the electric wire end portion inside the terminal main part by applying an electric current between a pair of first and second electrodes in a state where the terminal main part is pressed from both sides thereof in the radial direction by the pair of first and second electrodes.

Another embodiment of the method according to the present invention further includes the step of inserting, into the electric wire end portion, a plurality of heat transmitting members each having a wire shape and being made of a metal having higher thermal conductivity than the electric wire end portion.

A further embodiment of the method according to the present invention is arranged such that a recess having a gently inclined side wall surface is provided in a surface of the terminal piece on which the electric wire end portion is soldered; and the other one of the pair of electrodes that presses the terminal piece presses part of the terminal piece that is located out of the recess on a side opposite to the terminal main part.

A still further embodiment of the method according to the present invention is arranged such that a pair of restricting walls are provided along respective side edges of the terminal piece; and the steps are performed in a state where spread of the electric wire end portion exposed on the terminal piece is restricted by the pair of restricting walls.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

FIG. 11 is a cross-sectional view for explaining problems to be solved by the present invention and illustrates a state where first to fourth electrodes are not pressed against a terminal main part, a terminal piece, and the like.

DESCRIPTION OF EMBODIMENTS

A method for producing a terminal connection structure for an electric wire end portion and the terminal connection structure according to an embodiment of the present invention are described below. A terminal 11 in the terminal connection structure is described with reference to FIGS. 1 to 3C. The terminal 11 includes a tubular terminal main part 11*a* and a terminal piece 11*b* having a flat-plate shape that is continuous with a front end side of the terminal main part 11*a*. The terminal 11 is formed from a plate material made of copper, brass, a copper alloy, or a copper-based composite material. The terminal piece 11*b* has a terminal hole 11*c*. The terminal 11 has a metal plating layer (not illustrated) made of tin or solder that is provided on at least a surface of inside of the terminal main part 11*a*. A recess 11*e* is provided in a soldering surface 11*d*, which is a top surface of the terminal piece 11*b*, and a pair of restricting walls 11*f* are provided along both side edges of the soldering surface 11*d*.

Figure 1:
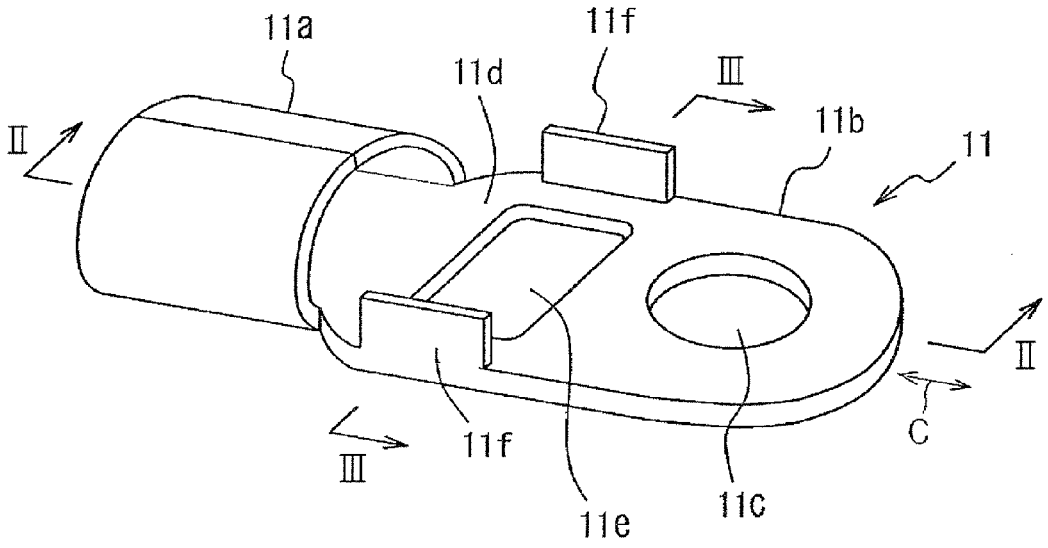
FIG. 1 is a perspective view of a terminal used in a terminal connection structure for an electric wire end portion according to an embodiment of the present invention.
Figure 2:
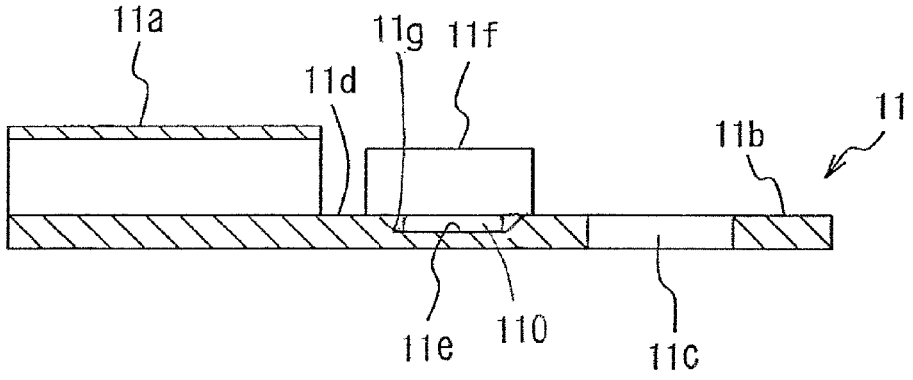
FIG. 2 is a cross-sectional view taken along line II-II of FIG. 1.
Figure 3A:
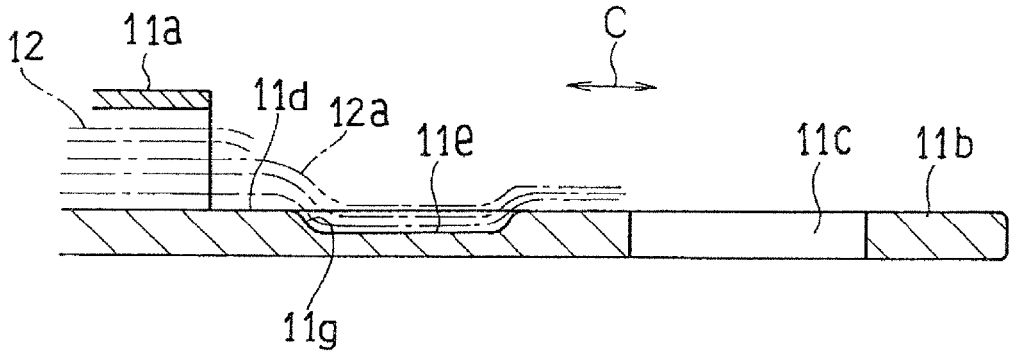
FIG. 3A is an enlarged cross-sectional view of a substantial part of FIG. 2.
Figure 3B:
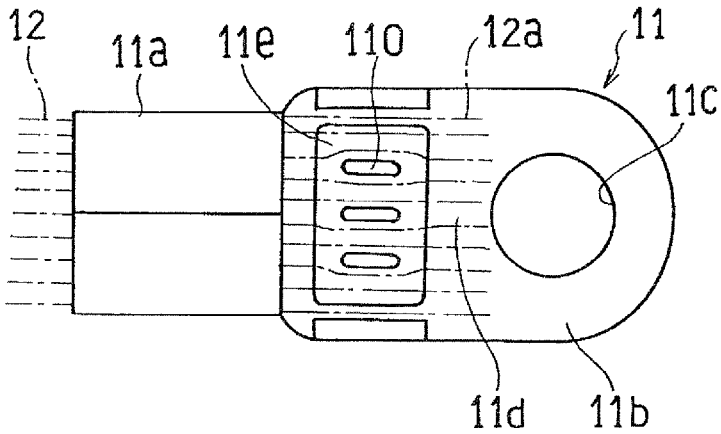
FIG. 3B is a plan view of the substantial part of FIG. 2.
Figure 3C:
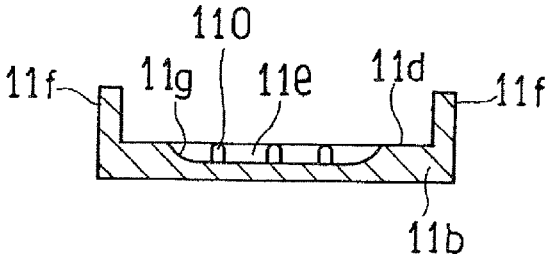
FIG. 3C is a cross-sectional view taken along line III-III of FIG. 1.

A side wall surface 11*g* of the recess 11*e* is a gentle slope, as illustrated in the enlarged view of FIG. 3A. The slope of the side wall surface 11*g* may be gentler according to need. The recess 11*e* acts as a flux reservoir and a solder reservoir when the electric wire end portion 12*a* is soldered on the soldering surface 11*d* of the terminal piece 11*b*, thereby allowing soldering to be accomplished well. The number of recesses 11*e* may be one or may be more than one. The width of the recess 11*e* in a direction orthogonal to a longitudinal direction C is approximately identical to an overall width of the electric wire end portion 12*a*, and the length of the recess 11*e* is shorter than the width thereof. The depth of the recess 11*e* is approximately ½ of the thickness of the terminal piece 11*b*.

A plurality of protrusions 110 are provided on a bottom surface of the recess 11*e*. Each of the protrusions 110 has an elongated shape extending in the longitudinal direction C, which is an axial direction, as is clear from FIG. 3B. A protruding end surface of each of the protrusions 110 is flush with the soldering surface 11*d*, which is a top surface of the terminal piece 11*b*, or is located slightly above or below the soldering surface 11*d*. Part of the electric wire end portion 12*a* passes between adjacent protrusions 110. The protrusions 110 increase a contact area between the electric wire end portion 12*a* and the terminal piece 11*b* and thereby promote thermal conduction between the electric wire end portion 12*a* and the terminal piece 11*b*. Furthermore, the protrusions 110 make it possible to evenly heat the electric wire end portion 12*a* to the inside thereof, thereby allowing soldering that will be described later to be accomplished well. Since the end surfaces of the protrusions 110 are close to an electrode 15*a*, heat transmission from the electrode 15*a* is improved, and therefore the protrusions 110 are effective especially in a case where an aluminum electric wire, which has lower thermal conductivity than copper, is used. The protrusions 110 may be omitted.

Figure 5A:
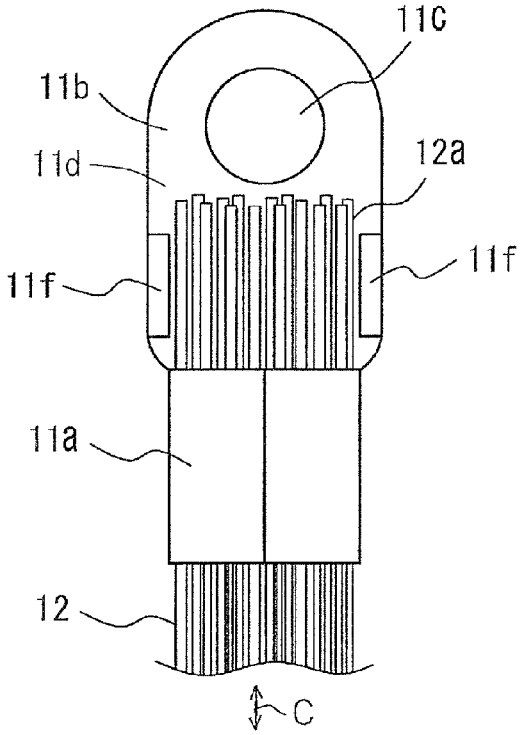
FIG. 5A is a plan view illustrating a state where the electric wire end portion is restricted by restricting walls of a terminal piece.
Figure 5B:
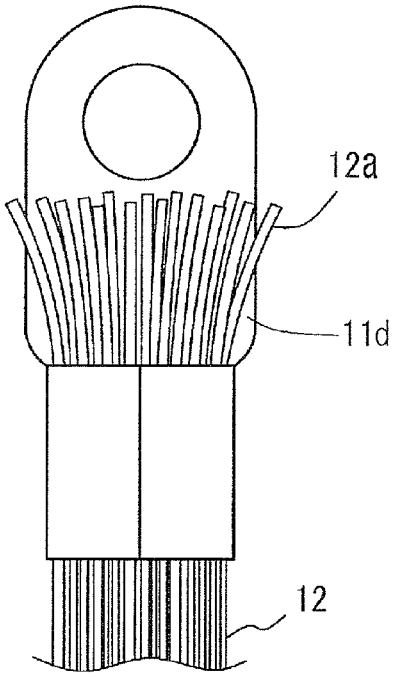
FIG. 5B is a plan view illustrating a state where the electric wire end portion is spread in a case where no restricting wall is provided on the terminal piece.

The restricting walls 11*f* rise in a direction of the soldering surface 11*d* and thus restrict spread of the overall width of the electric wire end portion 12*a* as illustrated in FIGS. 5A and 5B. To make this restricting effective, the restricting walls 11*f* are preferably located lateral to the recess 11*e*.

Figure 4:
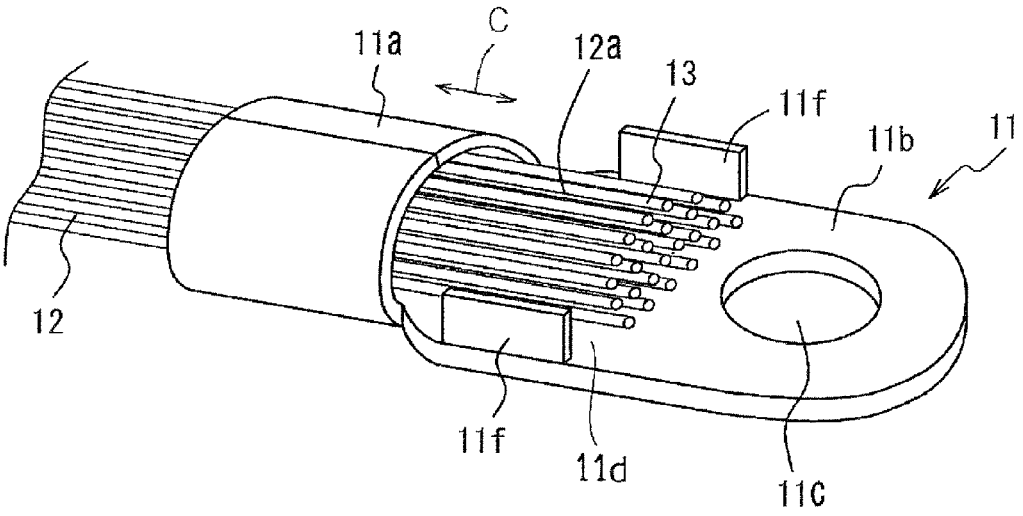
FIG. 4 is a cross-sectional view of a state where an electric wire is inserted into a terminal main part.

In the terminal 11 configured as above, an electric wire 12 made of aluminum, copper, or the like is mounted from an opening of the terminal main part 11*a* on one side, and an end 12*a*, which is a front end portion of the electric wire 12, is soldered inside the terminal main part 11*a* and on the soldering surface 11*d* which is a top surface of the terminal piece 11*b*, as illustrated in FIG. 4. The electric wire 12 is formed of a large number of aluminum wires twisted together. Enamel insulation coating is removed from an end of the twisted wires. In the following description, enamel insulation coating is removed in advance from a part of the twisted wires from which the coating need be removed. The present invention is not limited to the twisted wires but encompasses collected wires obtained by merely collecting a plurality of wires.

A plurality of linear heat transmitting members 13 are inserted into the electric wire end portion 12*a* inside the terminal main part 11*a* so as to be disposed apart from one another by a predetermined interval in parallel with the longitudinal direction C of the electric wire end portion 12*a*. The heat transmitting members 13 are inserted into the electric wire end portion 12*a* while keeping the linear shape so as to form high-temperature passages in the electric wire end portion 12*a* during soldering, and in this state, solder (not illustrated) is introduced to the inside of the terminal main part 11*a* through the high-temperature passages. The heat transmitting members 13 also have a function of promoting flow of the solder and flux in the electric wire end portion 12*a*. The number of heat transmitting members 13 inserted into the electric wire end portion 12*a* may be more than one or may be one.

The heat transmitting members 13 are made of a metal (e.g., copper) having higher thermal conductivity than the electric wire end portion 12*a*, and a metal plating layer having a thickness of approximately 6μ to 10μ and made of a material such as tin or solder is provided on a surface of each of the heat transmitting members 13. The metal plating layer (not illustrated) on the surface of the terminal 11 and the metal plating layer on the surfaces of main body of the heat transmitting members 13 melt due to high heat applied to the terminal 11 during soldering. This makes it easier to form the high-temperature passages.

The electric wire end portion 12*a* is aligned along the pair of restricting walls 11*f* without spreading the overall width on the soldering surface 11*d* of the terminal piece 11*b* because of the pair of restricting walls 11*f*, as illustrated in FIG. 5A. Without the restricting walls 11*f*, the overall width of the electric wire end portion 12*a* expands on the soldering surface 11*d* as illustrated in FIG. 5B, and it is therefore impossible to accomplish soldering well.

Figure 6:
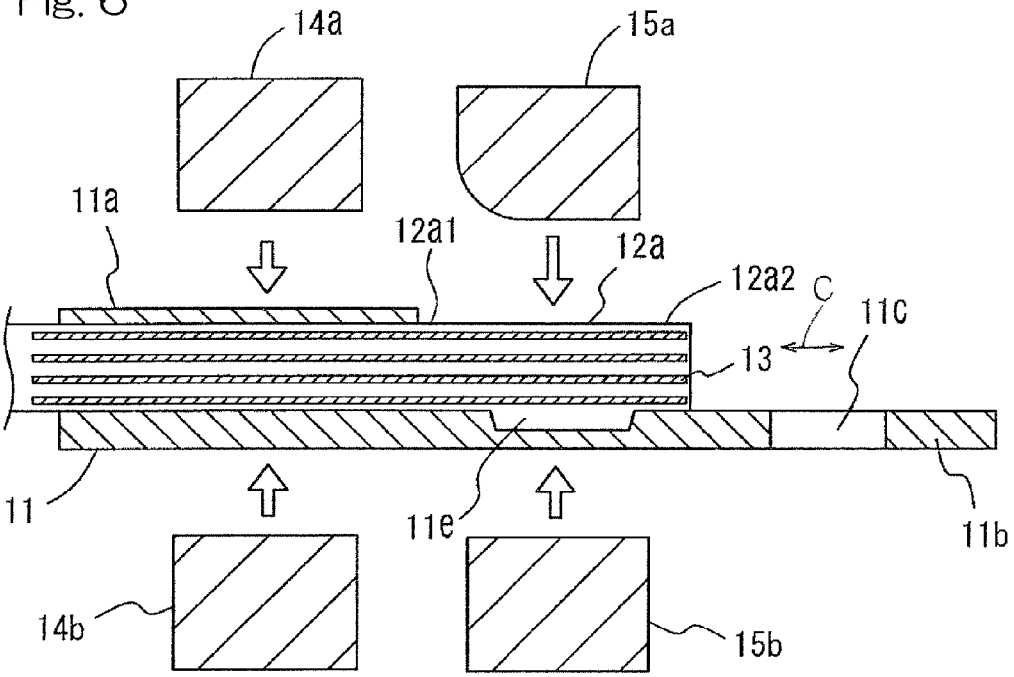
FIG. 6 is a cross-sectional view illustrating a state where the electric wire end portion is inserted into the terminal main part of the terminal and is exposed on the terminal piece and where electrodes are disposed on respective sides of the terminal main part and on respective sides of the terminal piece in a radial direction.

Next, a soldering method according to the embodiment is described with reference to FIGS. 6 to 8. First, the electric wire end portion 12*a* is inserted into the terminal main part 11*a* and is exposed on the terminal piece 11*b* outside the terminal main part 11*a*, as illustrated in FIG. 6. Next, a pair of first and second electrodes 14*a* and 14*b* are disposed on outer sides in a radial direction of the terminal main part 11*a* so as to face each other, and a pair of third and fourth electrodes 15*a* and 15*b* are disposed on outer sides in a radial direction of the terminal piece 11*b* outside the terminal main part 11*a* and the electric wire end portion 12*a* on the terminal piece 11*b* so as to face each other.

Figure 7A:
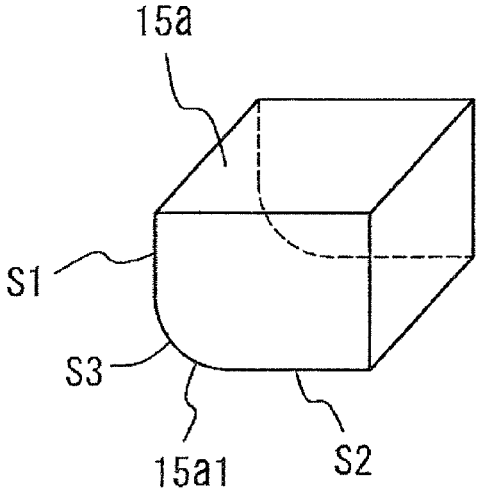
FIG. 7A is a diagram illustrating an example of the shape of a third electrode of FIG. 6.
Figure 7B:
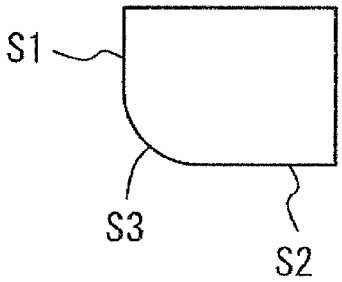
FIG. 7B is a diagram illustrating an example of the shape of the third electrode of FIG. 6.

In this case, each of the first and second electrodes 14*a* and 14*b* and the fourth electrode 15*b* has a cubic shape, whereas the third electrode 15*a* has a shape such that an edge part thereof on the radially inner side and on the terminal main part 11*a* side has a shape of a predetermined curved surface bulging toward the terminal main part 11*a* as illustrated in FIG. 7A. This shape of a curved surface is described below. As illustrated in FIG. 7B, for example, the third electrode 15*a* has a curved surface S3 between: a flat side surface S1 extending in a direction orthogonal to the soldering surface 11*d* of the terminal piece 11*b* from the terminal main part 11*a*, i.e., in a direction orthogonal to the longitudinal direction C; and a flat bottom surface S2 that faces the electric wire end portion 12*a* on the terminal piece 11*b*. The curved surface S3 has a large radius of curvature and is gently curved.

Figure 7C:
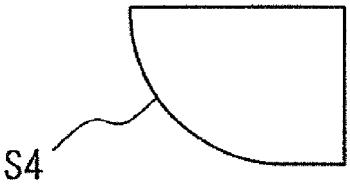
FIG. 7C is a diagram illustrating an example of the shape of the third electrode of FIG. 6.
Figure 7D:
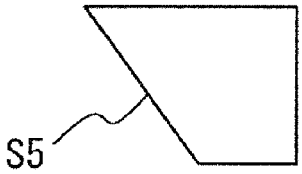
FIG. 7D is a diagram illustrating an example of the shape of the third electrode of FIG. 6.

The shape of the curved surface S3 includes not only a partial cylindrical surface, but also a shape that changes in an exponential manner or in a parabolic manner. In this case, the third electrode 15*a* may have a curved surface S4 obtained by curving the entire surface facing the electric wire end portion 12*a* while eliminating the side surface S1, as illustrated in FIG. 7C. Alternatively, a flat tapered surface S5 may be employed instead of a curved surface, as illustrated in FIG. 7D. Even in a case where the flat tapered surface S5 is employed, an electric wire part against which the tapered surface S5 is pressed is made into a curved surface owing to springback.

Figure 8:
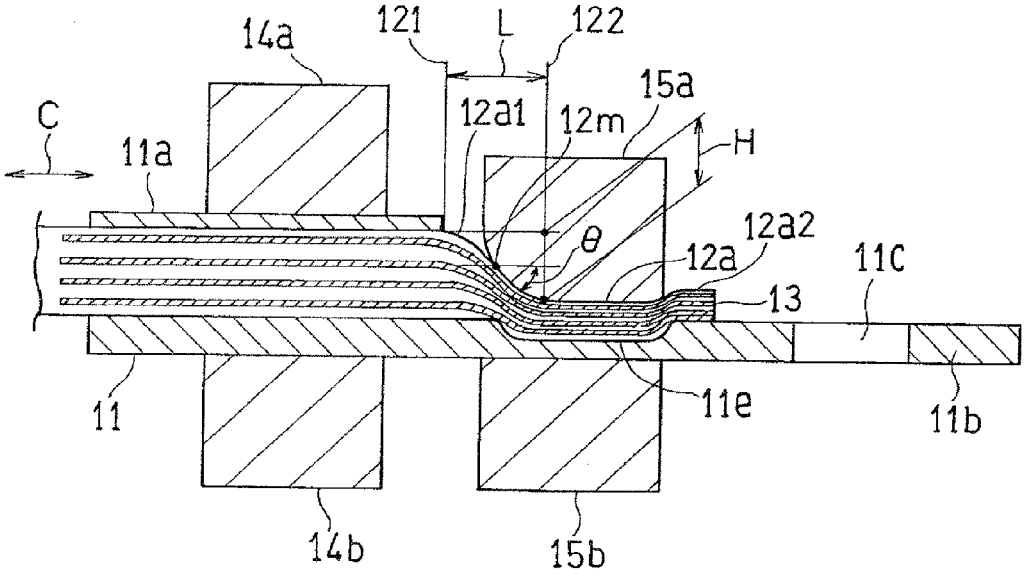
FIG. 8 is a cross-sectional view illustrating a state where the terminal main part, the terminal piece, and the like are pressed by the first to fourth electrodes.

Next, as illustrated in FIG. 8, the first and second electrodes 14*a* and 14*b* are pressed against the terminal main part 11*a* from both sides thereof in the radial direction, so that the terminal main part 11*a* is nipped by the first and second electrodes 14*a* and 14*b*. In this state, the terminal main part 11*a* is heated by applying an electric current between the first and second electrodes 14*a* and 14*b*.

Similarly, the third and fourth electrodes 15*a* and 15*b* are pressed against the terminal piece 11*b* outside the terminal main part 11*a* and against the electric wire end portion 12*a* on the terminal piece 11*b* from both sides thereof in the radial direction, so that the electric wire end portion 12*a* and the terminal piece 11*b* are nipped by the third and fourth electrodes 15*a* and 15*b*. In this state, the terminal piece 11*b* and the electric wire end portion 12*a* are heated by applying an electric current between the third and fourth electrodes 15*a* and 15*b*. A method for applying an electric current is not limited in particular.

In this case, an edge part 15*a*1 (FIG. 7A) of the third electrode 15*a* on the radially inner side and on the terminal main part 11*a* side is the curved surface S3 or the tapered surface S5, and therefore in a case where the electric wire end portion 12*a* is temporarily sectioned to a first end section 12*a*1 close to the terminal main part 11*a* and a second end section 12*a*2 on the front end side far from the terminal main part 11*a*, the first end section 12*a*1 is gently curved or tapered so as to approach the terminal piece 11*b* toward the second end section 12*a*2, i.e., toward the front end side. Accordingly, in a case where the electric wire end portion 12*a* on the terminal piece 11*b* is soldered by pressing the third and fourth electrodes 15*a* and 15*b* against the electric wire end portion 12*a*, the first end section 12*a*1 of the electric wire end portion 12*a* is not pressed against the soldering surface 11*d*, which is the inner side of the terminal piece 11*b*, by the third electrode 15*a*, whereas the second end section 12*a*2 is pressed against the soldering surface 11*d* by the third electrode 15*a*. This prevents formation of a steep difference in height between the first end section 12*a*1 and the second end section 12*a*2.

That is, the electric wire end portion 12*a* is gently curved between a rear edge 121 which is the highest portion of the curved first end section 12*a*1 on an upper side (side far from the terminal piece 11) of the first end section 12*a*1, and a rear edge 122 of the second end section 12*a*2 at which the curve ends and a straight part starts, and a ratio (L/H) of a dimension L in the longitudinal direction between the rear edges 121 and 122 to a height difference H between the rear edges 121 and 122 is 0.4 to 2.8, preferably 0.7 to 2.5, more preferably 1.0 to 2.0. The above three ranges of the ratio L/H are 20° to 70°, preferably 20° to 55°, more preferably 25° to 45° when expressed by an inclination angle θ of a longitudinal-direction intermediate part 12*m* of the first end section 12*a*1 with respect to the longitudinal direction C. In a case where the inclination angle θ is 70° or more, the first end section 12*a*1 is steeply curved, and the electric wire end portion 12*a* is more likely to be damaged. In a case where the inclination angle θ is less than 20°, the first end section 12*a*1 becomes too long, and the size of the terminal connection structure becomes large.

Furthermore, since a part of the terminal piece 11*b* in which the recess 11*e* is not provided is pressed by the third and fourth electrodes 15*a* and 15*b* with the electric wire end portion 12*a* interposed therebetween, a sufficient amount of electric current flows on the second end section 12*a*2 side of the electric wire end portion 12*a* so as to heat the second end section 12*a*2 side, whereas the temperature inside the recess 11*e* does not become high, and heat is gradually transmitted. This heat gradually evaporates the flux accumulated in the recess 11*e* and allows solder introduced from the second end section 12*a*2 to the first end section 12*a*1 to be sufficiently introduced into the electric wire end portion, whereby the electric wire end portion is soldered. In this case, because of the recess 11*e*, gentle inclination of the side wall surface 11*g* of the recess 11*e*, and taper of the edge part 15*a*1 of the third electrode 15*a*, damage of the electric wire end portion 12*a* caused by heat is small, and since excessive stress does not act, mechanical damage of the electric wire end portion 12*a* is also small.

The above configuration prevents formation of a sharp difference in height between the first end section 12*a*1 and the second end section 12*a*2 of the electric wire end portion 12*a* outside the terminal main part 11*a*. Thus, during soldering, the electric wire end portion 12*a* is hard to be broken, and owing to the recess 11*e*, a flux is less apt to evaporate and is maintained for a long period. As a result, the electric wire end portion 12*a* can be soldered onto the soldering surface 11*d* of the terminal piece 11*b* with high reliability.

In the electric wire end portion 12*a*, the heat transmitting members 13 are almost parallel with the twisted wires of the electric wire end portion 12*a*. Upon application of heat to the terminal main part 11*a* from outside, high heat is transmitted to the heat transmitting members 13. This melts the metal plating layer provided on each of the heat transmitting members 13, thereby forming a high-temperature passage around each of the heat transmitting members 13. In this state, a flux and molten solder such as aluminum solder are introduced into the terminal main part 11*a* from above. The flux introduced into the terminal main part 11*a* flows into the electric wire end portion 12*a* along the heat transmitting parts 13 having a high temperature and expands to the inside of the terminal main part 11*a*.

Furthermore, the flux is absorbed into the electric wire end portion 12*a* due to a capillary action caused by gaps around each of the heat transmitting members 13. As a result, the flux acts on the surface of the electric wire end portion 12*a* and removes an oxide film formed on the surface of the electric wire end portion 12*a*. Next, the introduced molten solder flows into the electric wire end portion 12*a* while being guided by the heat transmitting members 13, as in the flux. As a result, the solder spreads inside the terminal main part 11*a* and connects the twisted wires of the electric wire end portion 12*a* to one another and connects the electric wire end portion 12*a* and the terminal main part 11*a*. In this way, inside the terminal main part 11*a*, the flux acts on the surface of the electric wire end portion 12*a*, and the molten solder makes contact with the electric wire end portion 12*a* from which the oxide film has been removed by the flux, thus forming a good soldered part having no void inside the terminal main part 11*a*.

Figure 9:
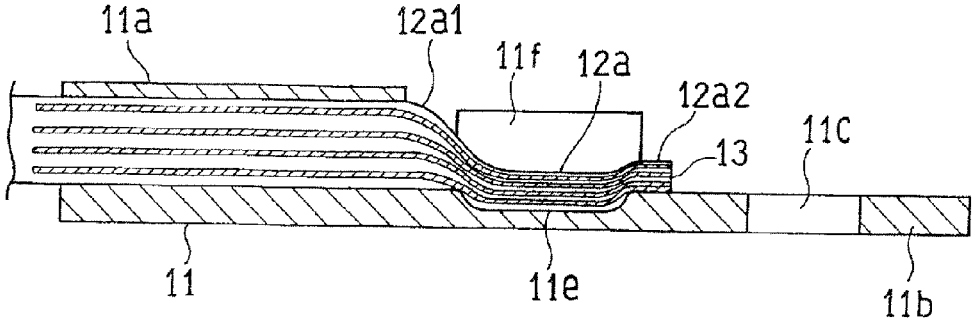
FIG. 9 is a cross-sectional view of the terminal connection structure according to the embodiment from which the first to fourth electrodes have been removed in FIG. 8.

FIG. 9 illustrates a terminal joining structure for an electric wire end portion after soldering in which no electrode is present. FIG. 9 illustrates a terminal connection structure from which electrodes have been removed after soldering in FIG. 8.

Figure 10A:
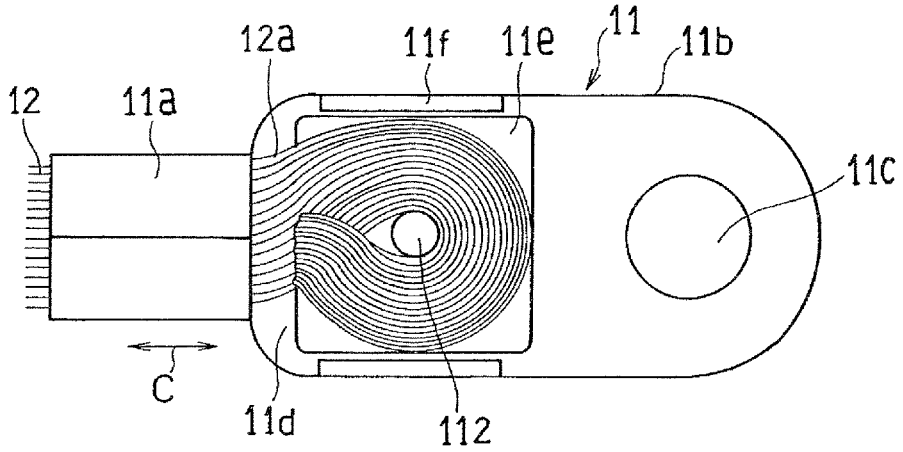
FIG. 10A is a plan view illustrating other embodiment.
Figure 10B:
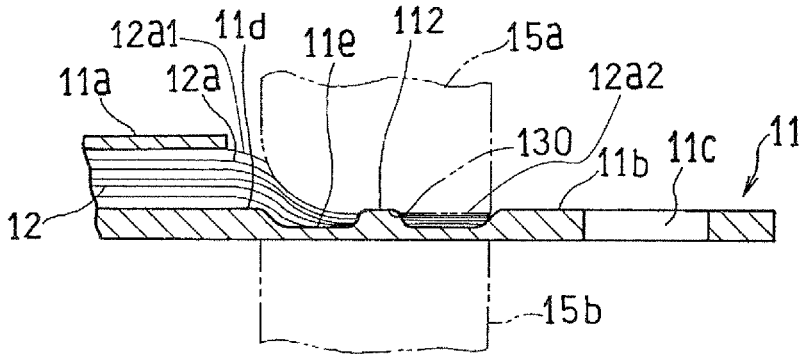
FIG. 10B is a longitudinal cross-sectional view of the other embodiment.
Figure 10C:
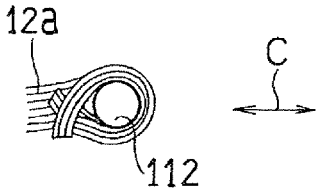
FIG. 10C is a plan view illustrating a modification.
Figure 11:
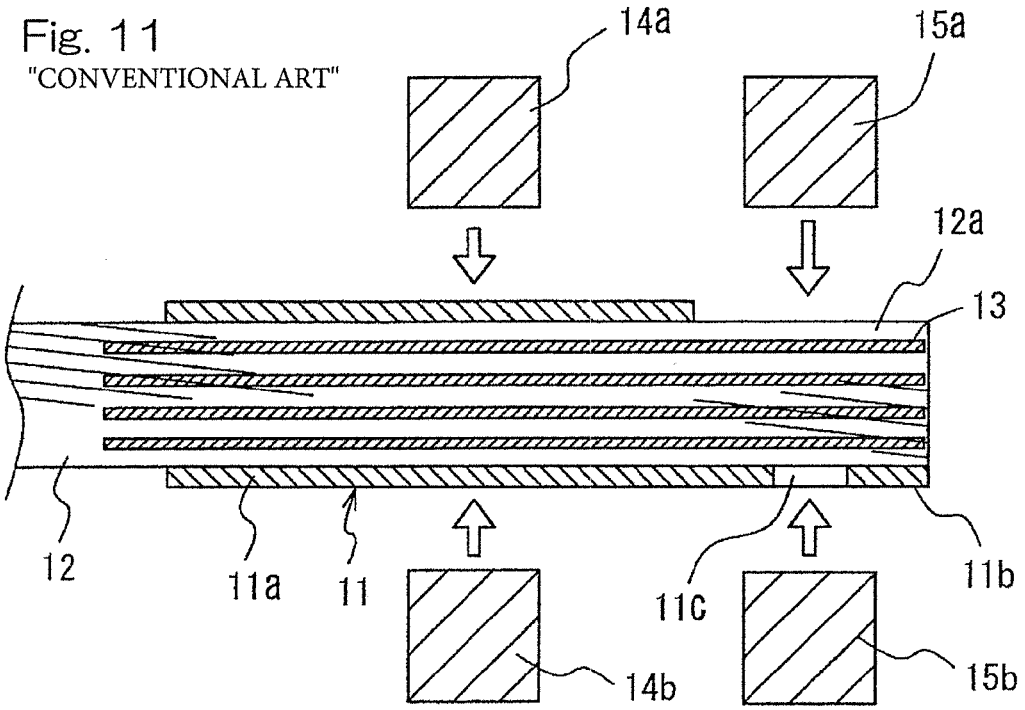
Figure 12:
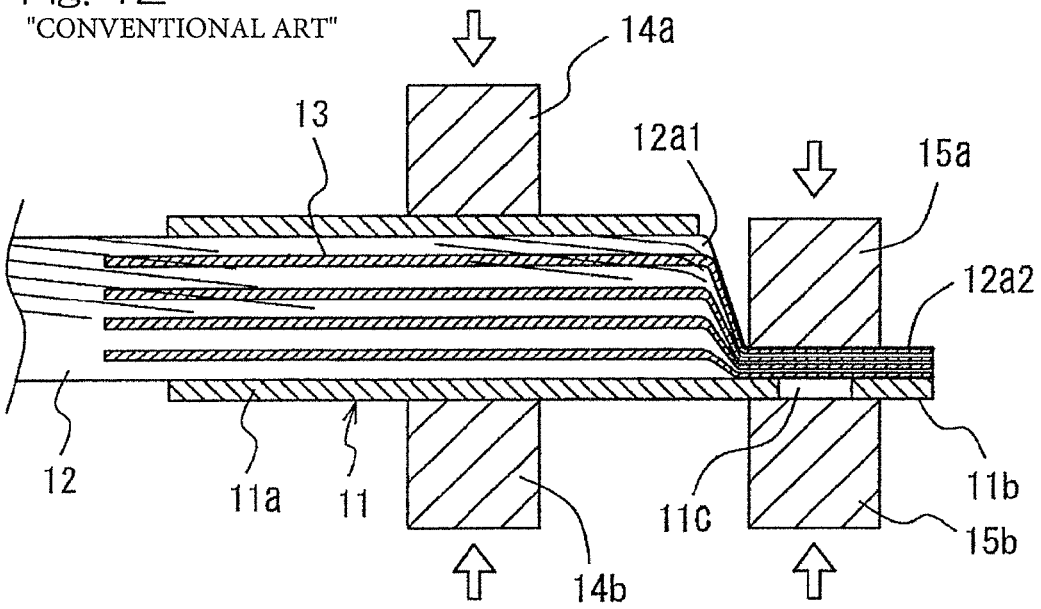
FIG. 12 is a cross-sectional view of a state where the first to fourth electrodes are pressed against the terminal main part, the terminal piece, and the like from the state of FIG. 11.

FIGS. 10A to 10C illustrate another embodiment. As illustrated in FIGS. 10A and 10B, a protrusion 112 is provided at the center of the recess 11*e*, and the second end section 12*a*2 of the electric wire end portion 12*a* is wound around the protrusion 112. The upper-side third electrode 15*a* has, on a bottom surface thereof, a recessed part 130 into which a top end of the protrusion 112 enters, and the second end section 12*a*2 is pressed into the recess 11*e* by the third electrode 15*a* and is firmly joined to the terminal 11 by solder accumulated in the recess 11*e*. The number of protrusions 112 may be more than one.

The electric wire end portion 12*a* may be divided into two parts in a width direction orthogonal to the longitudinal direction C, and the divided parts may be wound around the protrusion 112, as illustrated in FIG. 10C. Thus, the electric wire end portion 12*a* is evenly heated to the inside thereof.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

REFERENCE NUMERALS

11 . . . terminal
11*a* . . . terminal main part
11*b* . . . terminal piece
11*d* . . . soldering surface
11*e* . . . recess
11*g* . . . side wall surface
11*f* . . . restricting wall

12 . . . electric wire
12*a* . . . electric wire end portion
12*a*1 . . . first end section
12*a*2 . . . second end section
13 . . . heat transmitting member
14*a* . . . first electrode
14*b* . . . second electrode
15*a* . . . third electrode (electrode that presses electric wire end portion)
15*b* . . . fourth electrode (electrode that presses electric wire end portion)
110 . . . protrusion for promoting thermal conduction
112 . . . protrusion for winding
S3, S4 . . . curved surface
S5 . . . tapered surface
θ . . . inclination angle

What is claimed is:

1. A terminal connection structure for an electric wire end portion, comprising:

a tubular main portion; and a flat-plate terminal portion that is continuous with a front end side of the tubular main portion, the flat-plate terminal portion including a terminal hole at an end opposite the tubular main portion and a recess arranged between the terminal hole and the tubular main portion, wherein the electric wire end portion is soldered being exposed on the flat-plate terminal portion out from inside of the tubular main part, the electric wire end portion exposed on the flat-plate terminal portion from the tubular main portion includes a first end section that is close to the tubular main portion and a second end section that is far from the tubular main portion, and the electric wire end portion has a shape, in side view, such that the first end section is compressed to have a gentle curved surface that approaches the terminal piece toward the second end section.

2. The terminal connection structure as claimed in claim 1, wherein a side wall surface of the recess closest to the tubular main portion has gradual slope, and an inclination angle θ of an intermediate part of the first end section in a longitudinal direction is 20° to 70° on an upper side that is a side farthest from a soldering surface on which the electric wire end portion on the flat-plate terminal portion is soldered.

3. The terminal connection structure as claimed in claim 1, wherein the flat-plate terminal portion further includes a protrusion that promotes thermal conduction between the electric wire end portion and the terminal piece, the protrusion being provided in the recess.

4. The terminal connection structure as claimed in claim 1, wherein the flat-plate terminal portion further includes a protrusion around which the electric wire end portion may be wound, the protrusion being provided in the recess.

5. The terminal connection structure as claimed in claim 1, further comprising:

a pair of restricting walls provided along respective side edges of the flat-plate terminal portion, and a soldering surface provided on an upper surface of the flat-plate terminal portion between the tubular main portion and the terminal hole, wherein the pair of restricting walls regulate spread of the electric wire end portion on the soldering surface on which the electric wire end portion on the flat-plate terminal portion is soldered.

6. A method of soldering an electric wire end portion in a terminal connection structure, the terminal connection structure including a terminal main part and a flat-plate terminal piece, where the flat-plate terminal piece is continuous with a front end of the terminal main part and includes a terminal hole at an end opposite from the terminal main part and a recess arranged between the terminal hole and the terminal main part, the method comprising the steps of:

heating the flat-plate terminal piece and the electric wire end portion by applying an electric current between a pair of electrodes in a state where the flat-plate terminal piece and the electric wire end portion exposed on the flat-plate terminal piece are pressed from both sides thereof in a radial direction by the pair of electrodes; and introducing a flux and solder into the inside of the terminal main part and onto the flat-plate terminal piece in a state where the flat-plate terminal piece and the electric wire end portion are heated, wherein one of the pair of electrodes that presses the electric wire end portion has a curved surface shape or a tapered surface shape at an edge part thereof that is on a radially inner side and on a terminal main part side.

7. The method as claimed in claim 6, further comprising:

heating the terminal main part and the electric wire end portion inside the terminal main part by applying an electric current between another pair of electrodes in a state where the terminal main part is pressed from both sides thereof in the radial direction by the other pair of electrodes.

8. The method as claimed in claim 6, further comprising:

inserting, into the electric wire end portion, a plurality of heat transmitting members each having a wire shape and being made of a metal having higher thermal conductivity than the electric wire end portion.

9. The method as claimed in claim 6, wherein the flat-plate terminal piece further includes a soldering surface between the terminal hole and the terminal main part, the recess has a gradually inclined side surface provided in the soldering surface of the flat-plate terminal piece on which the electric wire end portion is soldered; and the steps are performed in a state where the other one of the pair of electrodes that presses the terminal piece presses part of the terminal piece that is located out of the recess on a side opposite to the terminal main part.

10. The method as claimed in claim 6, wherein the flat-plate terminal piece includes a pair of restricting walls provided along respective side edges of the flat-plate terminal piece; and the steps are performed in a state where spread of the electric wire end portion exposed on the terminal piece is restricted by the pair of restricting walls.

* * * * *